US007043761B2

(12) United States Patent
Epling

(10) Patent No.: US 7,043,761 B2
(45) Date of Patent: May 16, 2006

(54) REMOVABLE INSULATED HEAD GEAR LINING

(76) Inventor: Stephen L. Epling, 500 Lewis Rd., No. 5, Sandston, VA (US) 23150

( * ) Notice: Subject to any disclaimer, the term of this patent is extended or adjusted under 35 U.S.C. 154(b) by 84 days.

(21) Appl. No.: 10/831,218

(22) Filed: Apr. 26, 2004

(65) Prior Publication Data

US 2005/0268382 A1 Dec. 8, 2005

(51) Int. Cl.
*A42B 1/00* (2006.01)

(52) U.S. Cl. ..... 2/7; 2/181; 2/181.4; 2/200.1; 2/272; 2/410

(58) Field of Classification Search ..... 2/410, 2/411, 412, 425, 181, 181.4, 200.1, 7, 414, 2/272, 182.1, 182.2
See application file for complete search history.

(56) References Cited

U.S. PATENT DOCUMENTS

| | | | | |
|---|---|---|---|---|
| 3,205,508 | A | 9/1965 | Cox | |
| 3,366,971 | A * | 2/1968 | Scherz | 2/412 |
| 3,457,563 | A * | 7/1969 | Marchello | 2/414 |
| 3,594,814 | A | 7/1971 | Schuessler et al. | |
| 4,439,871 | A * | 4/1984 | Plastino | 2/422 |
| 4,685,155 | A * | 8/1987 | Fingerhut et al. | 2/272 |
| 4,868,928 | A * | 9/1989 | Norvell | 2/272 |
| 5,022,095 | A | 6/1991 | Fleury | |
| 5,025,504 | A * | 6/1991 | Benston et al. | 2/181.4 |
| 5,481,759 | A * | 1/1996 | Rinaldi | 2/195.1 |
| 5,566,395 | A | 10/1996 | Nebeker | |
| 5,575,009 | A * | 11/1996 | Ryvin | 2/173 |
| 5,630,230 | A * | 5/1997 | Fujino et al. | 2/200.1 |
| 5,887,289 | A * | 3/1999 | Theoret | 2/425 |
| 5,913,412 | A * | 6/1999 | Huber et al. | 2/414 |
| 5,915,537 | A * | 6/1999 | Dallas et al. | 2/410 |
| 6,806,215 | B1 * | 10/2004 | Grilliot et al. | 442/268 |
| 2004/0034903 | A1 * | 2/2004 | Blair | 2/411 |
| 2005/0166302 | A1 * | 8/2005 | Dennis | 2/414 |

FOREIGN PATENT DOCUMENTS

| | | | |
|---|---|---|---|
| GB | 2202729 | A * | 10/1988 |
| JP | 06173108 | A * | 6/1994 |

* cited by examiner

*Primary Examiner*—Rodney Lindsey
(74) *Attorney, Agent, or Firm*—Siemens Patent Service, LC

(57) ABSTRACT

The present invention features a removable liner for headgear. The inventive liner is specifically configured for placement within a cap member, hat, or any sort of headwear for enhanced thermal comfort. The liner is comprised of two shell layers that are made from choice performance materials. The two constituent shells are formed together to provide localized climate control for the head of the wearer. A first inner shell, adapted for contact with the wearer, is an ultrathin, thermally reflective, synthetic, microfibrous fabric. This inner shell removes moisture and allows airflow (for heat and perspiration removal. The second, outer shell is a multi-membrane fabric, forms an insulative, breathable, windproof, waterproof layer that lies between the headgear and the first inner shell.

10 Claims, 1 Drawing Sheet

FIG 1
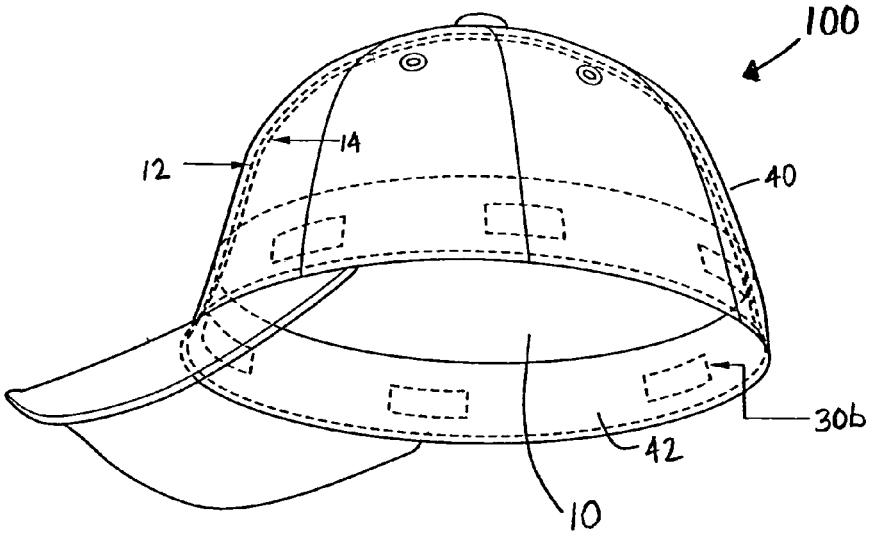
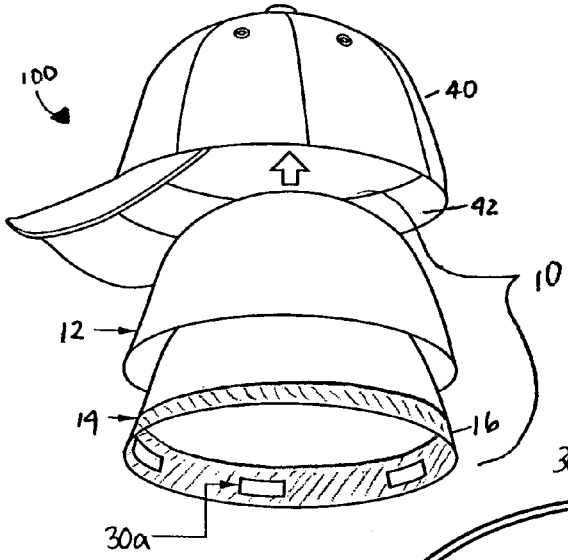
Fig 2
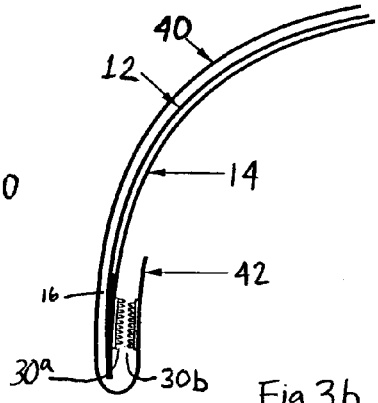
Fig 3b
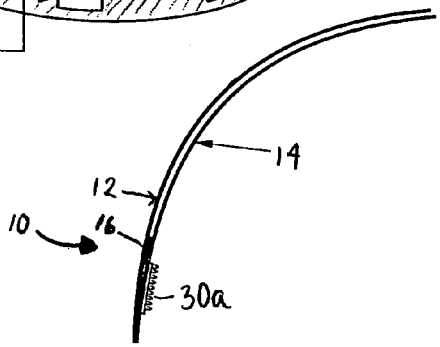
Fig 3a
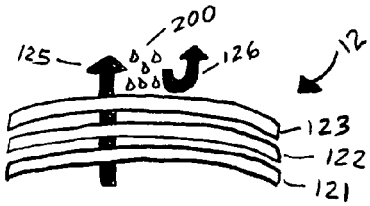
Fig. 4

REMOVABLE INSULATED HEAD GEAR LINING

BACKGROUND OF THE INVENTION

1. Field of the Invention

The present invention relates to an insulative accessory apparatus for apparel and, more particularly, to a removable insulative lining for headgear.

2. Discussion of the Prior Art

The prior art is replete with devices that attempt to address the problem of thermal comfort of headgear having increased layers or liners for cold weather.

The U.S. patent to Schuessler (U.S. Pat. No. 3,594,814) teaches of a liner for use in hard hats for providing protection from cold weather. It is especially configured for a harness, is not comprised of shell layers, and fails to address the issue of thermal comfort.

The U.S. patent to Nebeker (U.S. Pat. No. 5,566,395) discloses a liner for hats wherein a circumferential liner is inserted on the interior of a hat to wick moisture away from the wearer. Herein the thermal comfort of the wearer is considered in a removable, multilayered liner. However, the problem is met with a less effective, bulkier means.

The U.S. patent Fleury (U.S. Pat. No. 5,022,095) teaches of a removable liner for use in hard hats. The liner provides an inexpensive, disposable soft liner that is of breathable material to aid in the comfort of the wearer. The liner is preferably a single sheet comprised of the Tyvek material which allows air and water vapor to flow through while disallowing the flow of liquid.

Cox discloses a safety helmet liner and assembly comprised of a fabric for greater warmth and comfort, in U.S. Pat. No. 3,205,508. The liner is a single shelled garment that is specifically designed to extend beyond the headgear.

None of these patents either teach or suggest the removable insulated lining with the degree of thermal comfort present in the instant invention. As will be seen in greater detail hereinafter, the present invention requires the use of two shells made of a first insulative shell in conjunction with a second shell that is a waterproof, breathable, micropourous, multilayered membrane. Further, the first, outer layer is adapted to be in contact with the headgear and the second, inner-layer is adapted to be in contact with the wearer.

SUMMARY OF THE INVENTION

The present invention features a removable liner for headgear. The inventive liner is specifically configured for placement within a cap member, hat, or any sort of headwear for enhanced thermal comfort. The liner is comprised of two shell layers that are made from choice performance materials. The two constituent shells are formed together to provide localized climate control for the head of the wearer.

A first inner shell, adapted for contact with the wearer, is an ultrathin, thermally reflective, synthetic, microfibrous fabric. This inner shell removes moisture and allows airflow (for heat and perspiration removal). The second, outer shell is a multi-membrane fabric, and forms an insulative, breathable, windproof, waterproof layer that lies between the headgear and the first inner shell.

It is therefore an object of the invention to provide a headwear assembly that enhances thermal comfort for the wearer by removing moisture from immediate contact with the wearer.

It is another object of the invention to provide a headwear liner with enhanced thermal comfort that is removable.

It is another object of the invention to provide a headwear assembly that enhances thermal comfort for the wearer by removing moisture from immediate contact with the wearer, and that may be adapted to be worn with various types of headwear.

It is also an object of the invention to provide a removable insulated lining headgear assembly that is flexible, comfortable, and lightweight.

It is a further object of the invention to provide a removable insulated lining headgear assembly that may be worn by users of different sizes.

These and other objects, features and advantages will be more apparent from a study of the enclosed text and the appended drawings.

BRIEF DESCRIPTION OF THE DRAWINGS

A complete understanding of the present invention may be obtained by reference to the accompanying drawings, when taken in conjunction with the detail description thereof and in which:

FIG. 1 is a side perspective view of the combination of the inventive removable insulated lining incorporated with headwear, forming a headgear assembly.

FIG. 2 is an exploded, perspective view of the inventive headgear assembly of FIG. 1.

FIG. 3*a* is a cross sectional view of the removable insulated lining

FIG. 3*b* is a cross sectional view of the headgear assembly.

FIG. 4 is a side view of the multilayered membrane that comprises the outer shell, in accordance with the present invention.

DESCRIPTION OF THE PREFERRED EMBODIMENT

In FIG. 1, a headgear assembly 100 is shown. The present invention is a removable lining 10 that has been specifically configured for placement within headgear to provide localized climate control for the head of the wearer. Generally speaking, this invention relates to a removable lining for use in headwear during cold weather for maintaining thermal comfort. Thermal comfort is achieved in apparel by balancing three major factors:

the rate of heat production of a wearer;
insulation value of worn garments; and
environmental temperature.

Of these three factors, it is easiest to alter the insulation value of worn garments. That is what the removable lining of the invention is designed to do.

FIG. 2 shows an exploded, side perspective view of the assembly 100. As shown, the inventive lining 10 is comprised of a composite of two shells 12, 14 formed together and specifically configured for placement within a hat, cap member or headgear 40. The materials of each of the shells 12 and 14 are specifically chosen such that when together and placed in a cap member 40, the assembly 100 forms an ultimate thermal comfort headgear. The performance properties of each of the shells in combination offer thermal insulation, moisture wicking, venting, breathablility, and moisture resistance.

Not only is the design for the assembly 100 particularly useful for cold weather wearing, the assembly 100 assures thermal comfort during intense physical activity. During intense activity, specific body areas will generate a great deal of heat, as well as moisture, in the form of perspiration. To facilitate both cooling and drying of the head area, the lining 10 worn beneath a hat or headgear 40 is designed to aid in both the cooling and drying of the head of the wearer.

The inner shell 14 of the lining 10, is designed to remove moisture and sweat that may be generated by the wearer of the headgear assembly 100, keeping the wearer dry and warm. To maintain a desired comfort level during and after intense physical activity, this inner shell 14 is provided to form a breathable and moisture wicking fabric layer. It is the inner shell 14 that is adapted for contact with the wearer.

The inner shell 14 is comprised of a fabric material that combines both moisture transport and thermal insulation properties. Insulative fabrics work by trapping air and by thermal reflection. The more air that is trapped, the more efficient the insulation. The preferred fabric material in an ultrafine, ultrathin, microfibrous, synthetic, thermal reflectant material. In addition to the above, the preferred insulative material is a lightweight, synthetic material such as a blend of olefin and polyester fibers such as offered under the THINSULATE™ brand.

To protect the wearer from extreme climates such as cold weather, the outer shell 12 is provided with the essential function of providing warmth. Outer shell 12 is comprised of a multi-membrane fabric that is specifically engineered to form an impenetrable barrier against wind and moisture while maintaining breathability.

As shown in FIG. 4, a series of membranes 121–123 form the outer shell 12. The first membrane 121 is uni-directionally permeable to air and water vapor (perspiration) 200, thus allowing heat and sweat to escape from the wearer's body (as depicted by arrow 125. This flow facilitates the body's natural cooling process by allowing perspiration vapor 200 to escape. Middle membrane 122 is an insulative layer to guard against wind cutting through to the wearer, thus preventing the windchill effect that depletes heat from the human body's microclimate.

The outer membrane 123 serves the purpose of waterproofing. Membrane 123 is one-way permeable so that moisture 200 is allowed to escape, such as in the form of perspiration vapor, while simultaneously being impenetrable to moisture 200 entering from the outside, as depicted by arrow 126. A preferred performance fabric material for outer shell 12 providing all of these attributes is the GORE-TEX™ brand fabric.

FIG. 3*a* shows the lining 10 with the constituent two shells 12 and 14 formed together. Outer shell 12 is attached to the first, inner shell 14 by any suitable attachment means. The shells 12 and 14 may be stitched, welded or bonded, sewn together or otherwise adhered to one another via securing mechanism (e.g., adhesive). Other attachment arrangements may also be suitable as would be apparent to one of skill in the art. The general shape of the lining 10 is of a dome-like, semi-hemispherical shape for anatomically fitting the head of a wearer.

The two shells 12 and 14 are formed together to make a composite lining 10. FIG. 3*b* shows the cross section of the headgear assembly 100. The removable lining 10 is attached via fastening means 30*a* and 30*b* to headgear 40. The headgear 40 has an interior portion with an inner flap 42 providing mating attachment for the first fastening means 30*a* of the lining 10 and the second fastening means 30*b* of the headgear 40.

For the sake of this disclosure, inner shell 14 has attachment means 16 located on a proximal, peripheral edge thereof (as seen in FIG. 2). The first and second fastening means 30*a* & 30*b* may comprise any sort of mating attachment means including hook and loop fasteners (such as those under the VELCRO brand), zipper type fasteners, buttons, snaps, and tie downs, to name but a few.

The fastening means 30*a* and 30*b* are closure elements that may be provided on the attachment means 16 (FIG. 2) located on the margin of the lining 10 or other areas of the lining 10 with complementary attachment elements at a compatible location. A series of fastening means 30A and 30*b* are illustrated, however, it is to be appreciated by one of ordinary skill in the art that more or fewer closure elements may be employed without departing from the scope of the invention. Furthermore, without departing from the scope of the invention, the lining 10 may also be provided with means for adjusting the size thereof, such as a cinching arrangement (not shown), which might include an elastic drawstring and cord lock, or engageable straps.

The headgear 40 may be any sort of hat, cap member or the sort. The headgear 40 may be constructed for wearing atop a wearer's head, being of a dome-like, semi-hemispherical shape in its distal portion, and/or may extend into other areas such as over the face, or over the ears of the wearer. The headgear 40 may be constructed of any suitable, pliable material such as, but not limited to cotton, linens, knits, woven and non-woven fabrics, or any combination thereof. The headgear 40 may have means for securing to the head of the wearer (not shown) such as a strap or the sort.

Since other modifications and changes varied to fit a particular operating requirements and environment will be apparent to those skilled in the art, the invention is not considered limited to the example chosen for purposes of disclosure, and covers all changes and modifications which do not constitute a departure from the true spirit and scope of the invention.

For example, the removable insulated lining mentioned above can be provided in a variety of knit or weave patterns, may include additional complete layers or coatings, aesthetic coatings, may be located in a variety of areas about the lining in addition to, or instead of, the locations illustrated and described, and may be constructed in a variety of shapes and sizes.

Further, while the lining has been generally described in connection with headwear, its application is not so limited and the inventive lining may be provided on other types of apparel including, but not limited to, pants, shorts, underwear, shirts, gloves, mittens, and other handwarmers, hats, caps and other headwarmers, facewarmers, socks and footwear.

Having thus described the invention, what is desired to be protected by Letters Patent is presented in the subsequent appended claims.

What is claimed is:

1. An insulative headgear assembly comprising:

a headgear member having a dome-shaped, substantially hemispherical portion configured and arranged to be worn on the head of a wearer, said headgear member having an interior and an exterior, an upper, distal portion and a lower, proximal edge portion, said interior being oriented to face the head of a wearer, said exterior being oriented for contact with the atmosphere surrounding a wearer, said head gear member having fastening means located on said interior for removably attaching to said headgear a removable insulative lining; and a removable insulative lining for selective placement within the interior of said headgear member, said lining having a dome-shaped hemispherical portion configured and arranged to be worn on the head of a wearer, said lining having an interior, an exterior, an upper, distal portion, and a lower, proximal edge portion, said lining comprising a composite structure having a first outer shell which directly contacts said headgear member when positioned therein, said first, outer shell comprising a multi-membrane fabric, and a second, inner shell adapted for direct contact with the head of a wearer, said second, inner shell comprising an ultrathin, microfibrous, synthetic, thermally reflectant fabric material layer.

2. The insulative headgear assembly as in claim 1, wherein said first and second shells are joined together at their respective proximal edge portions.

3. The insulative headgear assembly as in claim 1, wherein said inner shell fabric material layer further comprises a blend of olefin and polyester fibers.

4. The insulative headgear assembly as in claim 1, wherein said multi-membrane fabric comprises: a first membrane which is one-way permeable to air and moisture; a second, intermediate insulative membrane; and a third, one-way permeable membrane allowing air and moisture to escape while preventing moisture from entering.

5. The insulative headgear assembly as in claim 1, wherein said inner shell comprises a lightweight fabric material that is permeable to both air and moisture.

6. A removable insulative lining for selective placement within the interior of headwear, said lining having a dome-shaped hemispherical portion configured and arranged to be worn on the head of a wearer, said liner having an interior, an exterior, an upper, distal portion, and a lower, proximal edge portion, said lining comprising a composite structure having a first outer shell adapted for directly contacting headwear when positioned therein, said first, outer shell comprising a multi-membrane fabric, and a second, inner shell adapted for direct contact with the head of a wearer, said second, inner shell comprising an ultrathin, microfibrous, synthetic, thermally reflectant fabric material layer.

7. The removable insulative lining as in claim 6, wherein said inner shell fabric material layer further comprises a blend of olefin and polyester fibers.

8. The removable insulative lining as in claim 6, wherein said first and second shells are joined together at their respective proximal edge portions.

9. The removable insulative lining as in claim 6, wherein said multi-membrane fabric comprises: a first membrane which is one-way permeable to air and moisture; a second, intermediate insulative membrane; and a third, one-way permeable membrane allowing air and moisture to escape while preventing moisture from entering.

10. The removable insulative lining as in claim 6, wherein said inner shell comprises a lightweight fabric material that is permeable to both air and moisture.

* * * * *